US005584241A

United States Patent [19]

Yuasa

[11] Patent Number: 5,584,241

[45] Date of Patent: Dec. 17, 1996

[54] PRINTING SWITCHING APPARATUS FOR SHEET-FED ROTARY PRESS WITH REVERSING MECHANISM

[75] Inventor: Yutaka Yuasa, Ibaragi, Japan

[73] Assignee: Komori Corporation, Japan

[21] Appl. No.: 485,641

[22] Filed: Jun. 7, 1995

Related U.S. Application Data

[63] Continuation of Ser. No. 334,213, Nov. 4, 1994, abandoned.

[30] Foreign Application Priority Data

Nov. 8, 1993 [JP] Japan ..... 5-064186 U

[51] Int. Cl.[6] ..... B41F 5/02

[52] U.S. Cl. ..... 101/230; 101/409; 271/82; 271/277

[58] Field of Search ..... 101/230, 183, 101/409, 410, 231, 232; 271/82, 277

[56] References Cited

U.S. PATENT DOCUMENTS

| | | | |
|---|---|---|---|
| 4,831,929 | 5/1989 | Saito | 101/230 |
| 5,031,531 | 7/1991 | Becker | 101/230 |
| 5,069,126 | 12/1991 | Becker | 101/230 |

FOREIGN PATENT DOCUMENTS

| | | |
|---|---|---|
| 0216045 | 7/1986 | European Pat. Off. . |
| 0243700 | 3/1987 | European Pat. Off. . |
| 0562608 | 3/1993 | European Pat. Off. . |
| 3315445 | 4/1983 | Germany . |
| 3526253 | 7/1985 | Germany . |
| 3526093 | 7/1985 | Germany . |
| 4-34034 | 8/1992 | Japan . |
| 1250921 | 6/1969 | United Kingdom . |
| 2108091 | 10/1982 | United Kingdom . |

*Primary Examiner*—Eugene H. Eickholt
*Attorney, Agent, or Firm*—Blakely Sokoloff Taylor & Zafman

[57] ABSTRACT

A printing switching apparatus for a sheet-fed rotary press with a reversing mechanism includes a fixed gear, a rotary gear, a fixing unit, and a proximity switch. The fixed gear is fixed to the shaft of a first cylinder. The rotary gear is coaxial with the fixed gear, coupled to be driven with a second adjacent cylinder along a paper convey direction, and phase-adjustable with respect to the fixed gear in a circumferential direction. The fixing unit fixes the rotary gear to one of the fixed gear and the shaft of the first cylinder to perform rotational transmission such that phase switching of the rotary gear between single-sided printing and perfecting printing is performed when the fixing means is released, and the rotary gear is not fixed to one of the fixed gear and the shaft of the first cylinder. The proximity switch detects that the rotary gear is positioned in a phase of single-sided printing when the rotary gear is fixed to one of the fixed gear and the shaft of the first cylinder by the fixing means.

8 Claims, 3 Drawing Sheets

PRINTING SWITCHING APPARATUS FOR SHEET-FED ROTARY PRESS WITH REVERSING MECHANISM

This is a continuation of application Ser. No. 08/334,213 filed Nov. 4, 1994, now abandoned.

BACKGROUND OF THE INVENTION

The present invention relates to a printing switching apparatus, arranged in a sheet-fed rotary press with a reversing mechanism capable of performing both single-sided printing and perfecting printing, for adjusting circumferential phases of upstream and downstream cylinders with respect to a reversing cylinder in switching between single-sided printing and perfecting printing.

Various sheet-fed rotary presses each capable of performing single-sided printing and perfecting printing have been proposed and put into practice along with a variety of printing techniques. An example of such a rotary press is disclosed in Japanese Utility Model Publication No. 4-34034 in which a transfer cylinder, a double-diameter cylinder having a diameter twice that of the transfer cylinder, and a reversing cylinder are arranged between an upstream impression cylinder and a downstream impression cylinder along a paper convey direction. The sheet-fed rotary press disclosed in this prior art has a fixed gear fixed at the end shaft of the reversing cylinder, a rotary gear coaxial with the fixed gear and phase-adjustable in a circumferential direction, and a single-sided printing reference pin free to be inserted into pin holes formed in the gears. When single-sided printing is to be performed, the reference pin is inserted into the pin holes of the fixed and rotary gears, thereby matching the phases of the fixed gear and the rotary gear in single-sided printing. When perfecting printing is to be performed, the reference pin is removed from the pin hole of the fixed gear, and the rotary gear is phase-adjusted with respect to the fixed gear by an almost the longitudinal length of a paper sheet. Because of such a reference pin, a paper sheet does not fail to be gripped between the double-diameter cylinder and the reversing cylinder. Therefore, waste paper or damage to the machine can be prevented.

However, in the above-described conventional printing switching apparatus for switching between single-sided printing and perfecting printing, if, in switching from single-sided printing to perfecting printing, an operator performs the switching operation while leaving the reference pin unremoved, the machine may be damaged. In addition, in switching from perfecting printing to single-sided printing, if the operator does not confirm that the reference pin is properly inserted into the pin hole of the fixed gear, the following problem is posed. If the fixed gear is phase-shifted from the rotary gear, the machine may be damaged at the time of start of single-sided printing.

SUMMARY OF THE INVENTION

It is an object of the present invention to provide a printing switching apparatus for a sheet-fed rotary press with a reversing mechanism, which automatically performs accurate positioning for phase adjustment in single-sided printing, thereby preventing damage to the machine.

In order to achieve the above object of the present invention, there is provided a printing switching apparatus for a sheet-fed rotary press with a reversing mechanism, comprising a fixed gear fixed to a shaft of a first cylinder, a rotary gear coaxial with the fixed gear and coupled to be driven with a second adjacent cylinder along a paper convey direction, the rotary gear being phase-adjustable with respect to the fixed gear in a circumferential direction, fixing means for fixing the rotary gear to one of the fixed gear and the shaft of the first cylinder to perform rotational transmission such that phase switching of the rotary gear between single-sided printing and perfecting printing is performed when the fixing means is released, and the rotary gear is not fixed to one of the fixed gear and the shaft of the first cylinder, and detecting means for detecting that the rotary gear is positioned in a phase of single-sided printing when the rotary gear is fixed to one of the fixed gear and the shaft of the first cylinder by the fixing means.

DESCRIPTION OF THE PREFERRED EMBODIMENT

Figure 1:
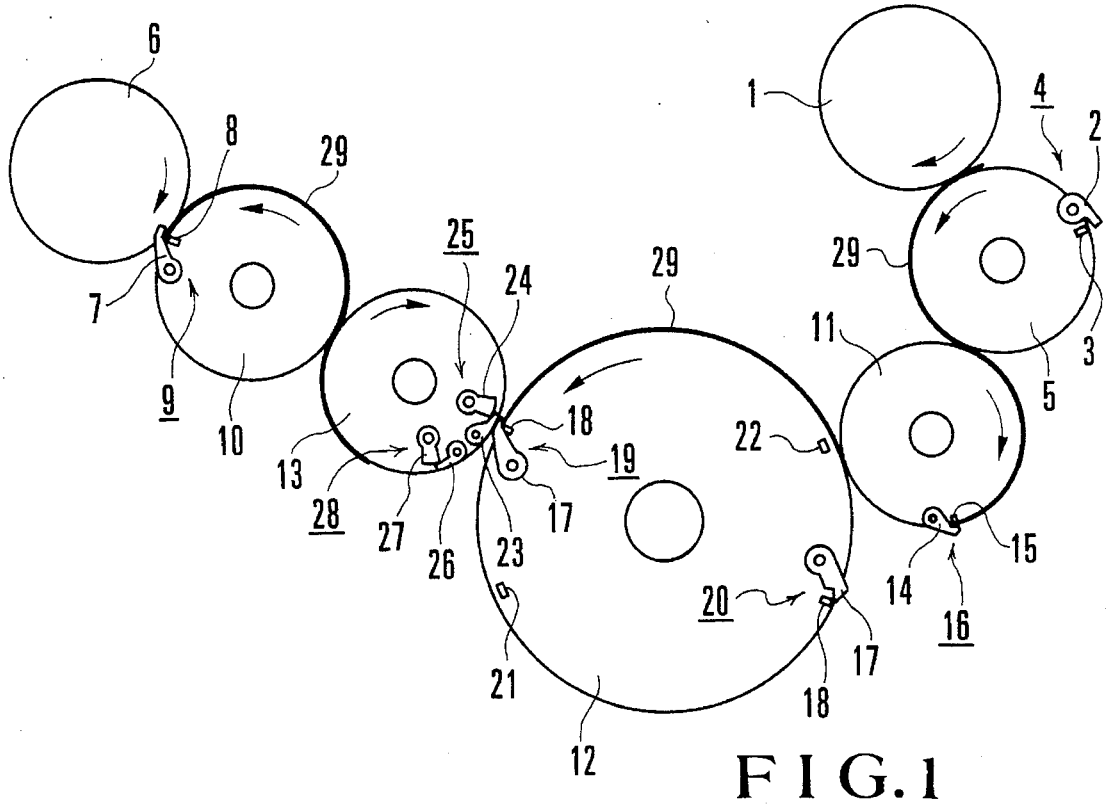
FIG. 1 is a view showing a cylinder arrangement so as to explain a single-sided printing operation in a sheet-fed rotary press with a reversing mechanism according to the present invention.
Figure 2:
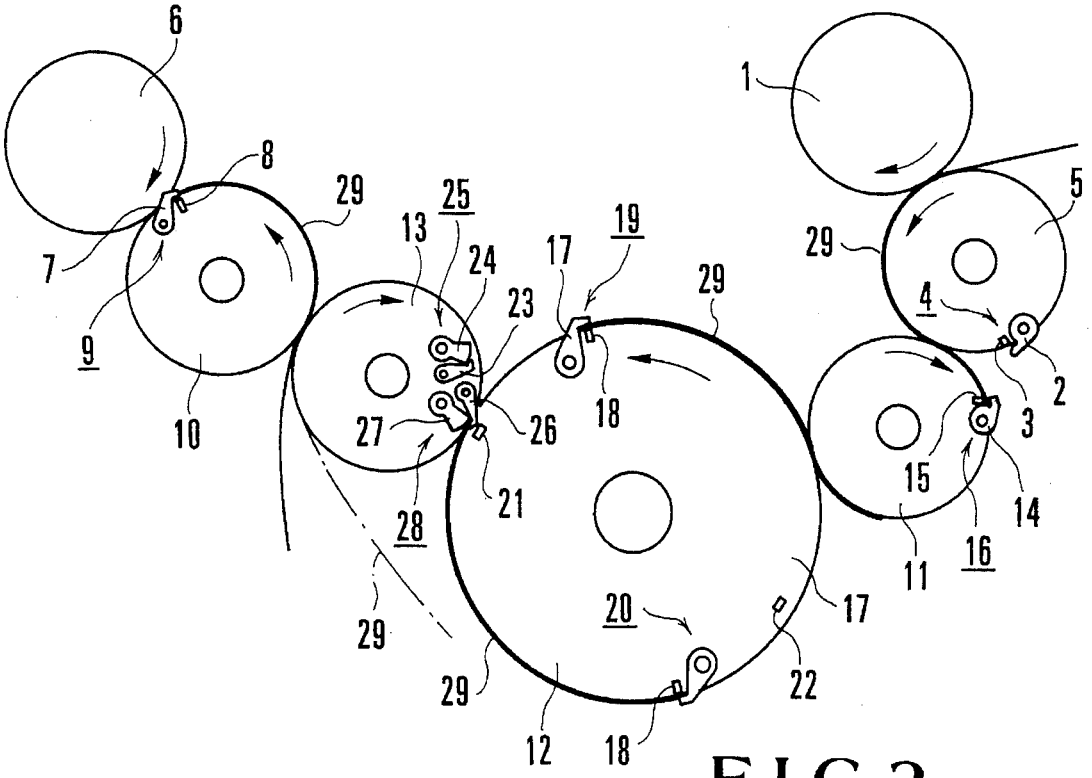
FIG. 2 is a view showing a cylinder arrangement so as to explain a perfecting printing operation in the sheet-fed rotary press with the reversing mechanism according to the present invention.
Figure 3:
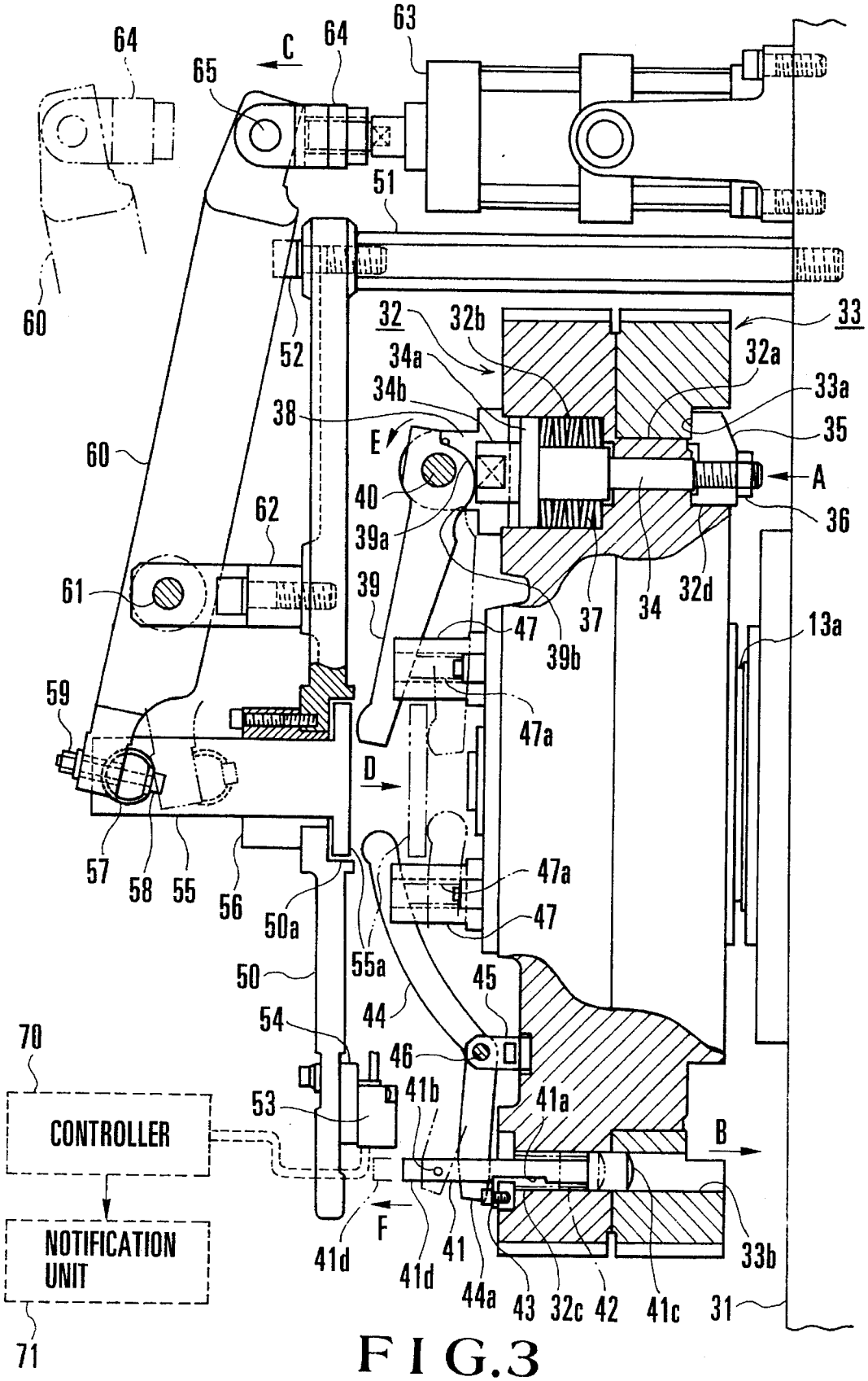
FIG. 3 is a partially cutaway sectional view showing a printing switching apparatus for the sheet-fed rotary press with the reversing mechanism according to an embodiment of the present invention.
Figure 4:
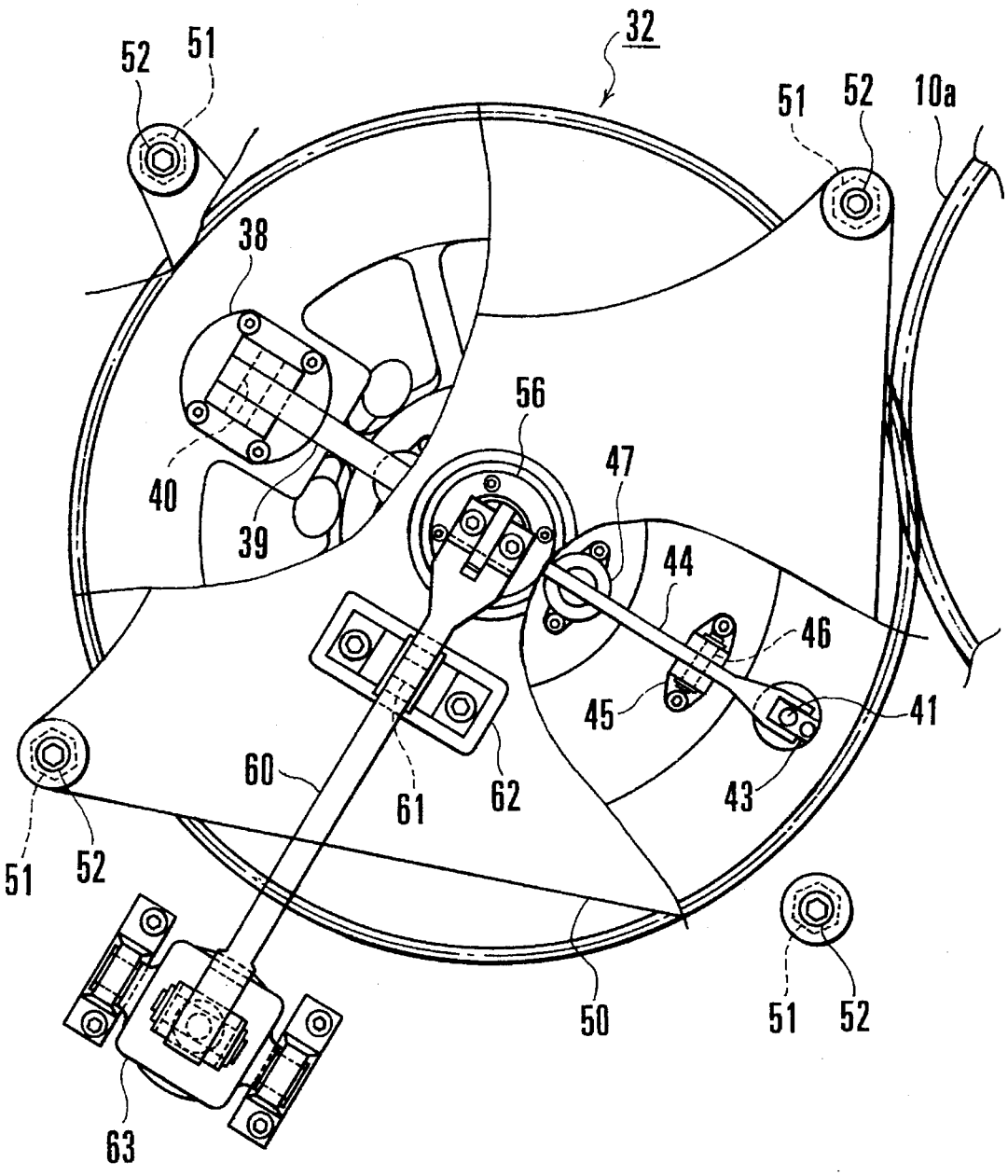
FIG. 4 is a partially cutaway front view showing the printing switching apparatus shown in FIG. 3.

An embodiment of the present invention will be described below with reference to the accompanying drawings. FIGS. 1 and 2 show cylinder arrangements so as to explain a single-sided printing operation and a perfecting printing operation in a sheet-fed rotary press with a reversing mechanism according to the present invention. FIG. 3 shows a printing switching apparatus in the sheet-fed rotary press with the reversing mechanism according to the present invention. FIG. 4 shows the printing switching apparatus shown in FIG. 3. Referring to FIGS. 1 and 2, a first impression cylinder 5 having a gripper unit 4 constituted by a plurality of sets of grippers 2 and gripper pads 3 axially and parallelly arranged in the gap extending in the axial direction of the cylinder 5 is in contact with a blanket cylinder 1 contacting a plate cylinder (not shown) mounted with a plate. A second impression cylinder 10 having a gripper unit 9 constituted by a plurality of sets of grippers 7 and gripper pads 8 axially and parallelly arranged in the gap extending in the axial direction of the cylinder 5 is in contact with a blanket cylinder 6 contacting a plate cylinder (not shown) mounted with a plate.

A transfer cylinder 11, a double-diameter cylinder 12 having a diameter twice that of the transfer cylinder 11, and a reversing cylinder 13, which are in contact with each other, are arranged between the first impression cylinder 5 and the second impression cylinder 10. A gripper unit 16 having a plurality of sets of grippers 14 and gripper pads 15 axially and parallelly arranged is provided in the gap extending in the axial direction of the cylinder 5. Gripper units 19 and 20 respectively having a plurality of sets of grippers 17 and gripper pads 18 axially and parallelly arranged are provided in the gaps at positions which divide the circumference of the double-diameter cylinder 12 into halves.

Suckers 21 and 22 movable in the circumferential direction are connected to a blower (not shown) through rotary valves (not shown) or the like at positions which divide the circumference of the double-diameter cylinder 12 into halves and are circumferentially phase-shifted from the gripper units 19 and 20 by about 45°. A gripper unit 25 having a plurality of sets of grippers 23 and gripper pads 24 axially and parallelly arranged and a reversing gripper unit 28 having a plurality of sets of grippers 26 and gripper pads 27 axially and parallelly arranged are provided in the notches extending in the axial direction of the reversing cylinder 13 at positions slightly phase-shifted in the circumferential direction.

Referring to FIG. 3, a fixed gear 32 is fixed with a bolt (not shown) to an end shaft 13*a* of the reversing cylinder 13 axially and rotatably supported by a frame 31. An annular stepped portion 32*a* is formed at the circumferential portion of the fixed gear 32. A plurality of stepped through holes 32*b* are also formed in the side surface portion of the fixed gear 32 to extend in the axial direction of the reversing cylinder 13 at an equal angular interval, and a through hole 32*c* is formed at a predetermined position. Each of the stepped through holes 32*b* extends through the inner side surface portion with respect to the stepped portion 32*a* of the fixed gear 32 to reach an annular recessed portion 32*d* formed in the stepped portion 32*a*. The through hole 32*c* extends through the outer surface portion with respect to the stepped portion 32*a* of the fixed gear 32. A rotary gear 33 is fitted on the stepped portion 32*a* of the fixed gear 32. An annular recessed portion 33*a* is formed in correspondence with the recessed portion 32*d* of the fixed gear 32. A through hole 33*b* having the same diameter as that of the through hole 32*c* is formed in correspondence with the through hole 32*c*.

A stepped bolt 34 having a flange portion 34*a* and a head portion 34*b* at one end is fitted in the stepped through hole 32*b* of the fixed gear 32. An engaging member 35 is fitted on the distal end of the stepped bolt 34 at the recessed portion 32*d* of the fixed gear 32. The engaging member 35 is threadably engaged with a nut 36 to be brought into contact with the recessed portion 33*a* of the rotary gear 33. A coned disc spring 37 is interposed between the stepped through hole 32*b* and the flange portion 34*a* of the stepped bolt 34. The stepped bolt 34 is biased by the elastic force of the coned disc spring 37 in a direction indicated by an arrow A in FIG. 3. The rotary gear 33 is locked with the fixed gear 32 by the engaging member 35 fitted on the stepped bolt 34 to rotate together with the fixed gear 32. The plurality of stepped bolts 34 are disposed at an equal angular interval on the side surface of the rotary gear 32 in correspondence with the stepped through holes 32*b*.

A bearing 38 is fixed to the fixed gear 32 at a position corresponding to the stepped through hole 32*b*. A lever 39 having a small-diameter portion 39*a* and a large-diameter portion 39*b* which are brought into contact with the head portion 34*b* of the stepped bolt 34 is swingably and pivotally supported by the bearing 38 through a shaft 40. A single-sided printing reference pin 41 is fitted in the through hole 32*c* of the fixed gear 32 and the through hole 33*b* of the rotary gear 33. A notch 41*a* is formed in the side surface of the single-sided printing reference pin 41 at the central portion. A pin 41*b* perpendicularly projects from a rear end portion 41*d* of the single-sided printing reference pin 41. A spring 42 is fitted in the through hole 32*c* of the fixed gear 32 and applies a biasing force to the single-sided printing reference pin 41 in a direction indicated by an arrow B in FIG. 3, i.e., in a direction to fit the distal end portion into the through hole 33*b* of the rotary gear 33. A stopper 43 is fixed at the inlet end of the through hole 32*c* of the rotary gear 32 and engaged with the stepped portion of the notch 41*a* of the single-sided printing reference pin 41, thereby preventing removal and pivotal motion of the single-sided printing reference pin 41.

A lever 44 is swingably and pivotally supported almost at its central portion by a shaft 46 held by a bracket 45 fixed to the fixed gear 32. The lever 44 extends to a position where one end portion 44*a* is engaged with the pin 41*b* of the single-sided printing reference pin 41. Cylindrical guide members 47 having silts for sandwiching and slidably guiding the levers 39 and 44 in pivotal directions are fixed to the fixed gear 32. Springs 47*a* for swingably biasing the levers 39 and 44 in a direction opposite to an arrow D are fitted in the guide members 47.

A flat plate-like cover 50 has a stepped hole 50*a* at the central portion. As shown in FIG. 4, the cover 50 is fixed at its four corners by bolts 52 to a plurality of stud bolts 51 extending from the frame 31, and arranged parallel to the frame 31 at a predetermined interval. In a state wherein a distal end portion 41*c* of the single-sided printing reference pin 41 is removed from the through hole 33*b* of the rotary gear 33, a proximity switch 53 serving as a detecting means is fixed on the lower surface of the cover 50 at a position opposing the rear end portion 41*d* of the single-sided printing reference pin 41 through a spacer 54. The proximity switch 53 detects a state wherein the distal end potion 41*c* of the single-sided printing reference pin 41 is not fitted in the through hole 33*b* of the rotary gear 33, and the rear end portion 41*d* projects from the through hole 32*c* of the fixed gear 32. A controller 70 drives a notification unit 71 only when a detection output from the proximity switch 53 represents a single-sided printing state. The switch 53 can be a switch for mechanically, optically, magnetically, or capacitively detecting the rear end portion 41*d* of the single-sided printing reference pin 41. A mechanical switch such as a limit switch may be used in place of the proximity switch 53.

A press member 55 having a collar portion 55*a* at the distal end portion is supported by a bearing bush 56 fixed to the cover 50 so as to freely slide in the axial direction of the fixed gear 32. A lever 60 is swingably supported by a shaft 61 held by a bracket 62 fixed to the cover 50. One end of the lever 60 is fixed by a bolt 58 and a nut 59 to a horizontal member 57 pivotally supported on the side surface of the press member 55, and coupled to the press member 55. The other end of the lever 60 is coupled to a rod 64 of an air cylinder 63 fixed to stand on the frame 31 through a pin 65.

In the above arrangement, an operation in switching from single-sided printing to perfecting printing will be described below. When a printing switching button (not shown) is switched to "perfecting", and thereafter a switching start button (not shown) is depressed, the air cylinder 63 is operated to move the rod 64 in a direction indicated by an arrow C in FIG. 3. The lever 60 swings about the shaft 61 to move the press member 55 in the direction indicated by the arrow D. When the press member 55 is moved, the collar portion 55*a* presses the levers 39 and 44. The lever 39 pivots about the shaft 40 in a direction indicated by an arrow E, and at the same time, one end portion 44*a* of the lever 44 pivots in a direction indicated by an arrow F. With the pivotal motion of the lever 39 in the direction indicated by the arrow E, the head portion 34*b* of the stepped bolt 43, which is in contact with the small-diameter portion 39*a*, is brought into contact with the large-diameter portion 39*b*, thereby moving the stepped bolt 34 against the elastic force of the coned disc spring 37 in a direction opposite to the arrow A. When the stepped bolt 34 is moved, the pressing force of the engaging member 35 fixed at the distal end of the stepped bolt 34, which acts on the recessed portion 33*a* of the rotary gear 33, is eliminated to release the rotary gear 33, pressed against and fixed to the fixed gear 32, from the fixed gear 32. With this operation, a locked state between the fixed gear 32 and the rotary gear 33 is released. As described above, the lever 39 and the air cylinder 63 are provided as a releasing means for releasing the fixing means, consisting of the coned disc spring 37 and the engaging member 35, for fixing the rotary gear 33 to the fixed gear 32. Therefore, the locked state between the two gears 32 and 33 can be automatically released.

At the same time, with the pivotal motion of one end portion 44*a* of the lever 44 in the direction indicated by the arrow F, one end portion 44*a* is engaged with the pin 41*b* of the single-sided printing reference pin 41, thereby moving the single-sided printing reference pin 41 against the elastic force of the spring 42 in the direction indicated by the arrow F. With this operation, the distal end portion 41*c* is removed from the through hole 33*b* of the rotary gear 33, and a disengaged state is set. As described above, the lever 44 and the air cylinder 63 are provided as a releasing means for the distal end portion 41*c* of the single-sided printing reference pin 41 and the through hole 33*b* of the rotary gear 33. For this reason, the single-sided printing reference pin 41 is prevented from being left unremoved in switching from single-sided printing to perfecting printing, so damage to the machine can be prevented. Additionally, the air cylinder 63 for releasing the rotary gear 33 is also used as a driving source for releasing the single-sided printing reference pin 41. Therefore, the releasing operation of the single-sided printing reference pin 41 and the switching operation from single-sided printing to perfecting printing can be automatically and simultaneously performed in an interlocked manner.

With release of the rotary gear 33 and release of the single-sided printing reference pin 41, the rotary gear 33 can pivot with respect to the fixed gear 32. From the single-sided printing state shown in FIG. 1, the upstream cylinders including the rotary gear 33 are pivoted by the longitudinal length of a paper sheet 29 by a driving means such as a motor (not shown) until the sucker 21 which is moved in the circumferential direction of the double-diameter cylinder 12 to a position corresponding to the longitudinal length of the paper sheet 29 opposes the gripper unit 28, as shown in FIG. 2. Thereafter, the air cylinder 63 is operated to retreat the rod 64 in a direction opposite to the arrow C. The levers 39 and 44 are released from the pressing force of the press member 55 and swung by the elastic force of the spring 47*a* in a direction opposite to the arrow D to restore positions indicated by solid lines. With the restoring operation of the levers 39 and 44, the lever 39 pivots about the shaft 40 in a direction opposite to the arrow E. The small-diameter portion 39*a* is brought into contact with the head portion 34*b* of the stepped bolt 34, so the stepped bolt 34 is moved by the elastic force of the coned disk spring 37 in the direction indicated by the arrow A. When the stepped bolt 34 is moved, the engaging member 35 fixed at the distal end presses the recessed portion 33*a* of the rotary gear 33 to set the rotary gear and the fixed gear 32 in a locked state.

On the other hand, one end portion 44*a* of the lever 44 moves in a direction opposite to the arrow F to be disengaged from the pin 41*a*. The through hole 33*b* of the rotary gear 33 is phase-shifted from the through hole 32*c* of the fixed gear 32. For this reason, the distal end portion 41*c* of the single-sided printing reference pin 41 is in contact with the side surface of the rotary gear 33 without being fitted in the through hole 33*b* of the rotary gear 33 regardless of the elastic force of the spring 42. The rear end portion 41*d* projects from the through hole 32*c* of the fixed gear 32 to oppose the proximity switch 53. In this case, the proximity switch 53 outputs a detection signal for the rear end portion 41*d* of the single-sided printing reference pin 41. However, since the printing apparatus is switched to perfecting printing, the controller 70 does not drive the notification unit 71.

Upon completion of this preparation, when a perfecting printing operation is started, as shown in FIG. 2, the paper sheet 29 whose upper surface has been printed between the blanket cylinder 1 and the first impression cylinder 5 is gripped from the gripper unit 4 of the first impression cylinder 5 to the gripper unit 16 of the transfer cylinder 11 and then from the gripper unit 16 of the transfer cylinder 11 to the gripper unit 19 or 20 of the double-diameter cylinder 12. The paper sheet 29 is wound on the upper-side surface of the double-diameter cylinder 12. In this state, when all the cylinders are continuously rotated, the trailing end of the paper sheet 29 opposes the sucker 21 of the double-diameter cylinder 12, so the sucker 21 draws this trailing end. When the all the cylinders continue to rotate, and the trailing end of the paper sheet 29 reaches the contact point between the double-diameter cylinder 12 and the reversing cylinder 13, the trailing end is released from the sucker 21 of the double-diameter cylinder 12 and gripped by the gripper unit 28 of the reversing cylinder 13. At the same time, the gripper unit 19 or 20 is opened to release the leading end. The gripper unit 28 of the reversing cylinder 13, which grips the trailing end, reverses and conveys the paper sheet 29. During conveyance, the paper sheet 29 is gripped from the gripper unit 28 of the reversing cylinder 13 to the gripper unit 25 of the reversing cylinder 13, which faces in a direction to grip the paper sheet, and then gripped by the gripper unit 9 of the second impression cylinder 10. The lower surface of the paper sheet 29 is printed while passing between the blanket cylinder 6 and the second impression cylinder 10, thereby performing perfecting printing.

When perfecting printing is to be switched to single-sided printing, the printing switching selection button (not shown) is switched to "single-sided" printing. When the switching start button (not shown) is depressed, the air cylinder 63 is operated to move the rod 64 in the direction indicated by the arrow C, as in the above-described perfecting printing. With the movement of the rod 64, the lever 60 and the levers 39 and 44 are swung. The lever 39 pivots about the shaft 40 in the direction indicated by the arrow E, and at the same time, one end portion 44*a* of the lever 44 is swung in the direction indicated by the arrow F, thereby releasing the locked state between the rotary gear 33 and the fixed gear 32. When one end portion 44*a* of the lever 44 is swung in the direction F, one end portion 44*a* is engaged with the pin 41*b* of the single-sided printing reference pin 41 to move the single-sided printing reference pin 41 against the elastic force of the spring 42 in the direction indicated by the arrow F. For this reason, the distal end portion 41*c* in contact with the side surface of the rotary gear 33 is separated therefrom.

In this state, the rotary gear 33 is pivoted by the driving means such as a motor (not shown) to adjust the phase such that the through hole 33*b* is matched with the through hole 32*c* of the fixed gear 32. Thereafter, the air cylinder 63 is operated to retreat the rod 64 in a direction opposite to the direction indicated by the arrow C. With this operation, as in the above-described perfecting printing, the lever 39 pivots about the shaft 40 in a direction opposite to the arrow E. With the pivotal motion of the lever 39, the small-diameter portion 39*a* is brought into contact with the head portion 34*b* of the stepped bolt 34, so the stepped bolt 34 is moved by the elastic force of the coned disk spring 37 in the direction indicated by the arrow A. The engaging member 35 fixed at the distal end of the stepped bolt 34 presses the recessed portion 33*a* of the rotary gear 33 to set the rotary gear 33 and the fixed gear 32 in a locked state.

One end portion 44*a* of the lever 44 is swung in a direction opposite to the arrow F to be disengaged from the pin 41*b*. The position of the through hole 33*b* of the rotary gear 33 is matched with that of the through hole 32*c* of the fixed gear 32. For this reason, the distal end portion 41*c* of the single-sided printing reference pin 41 is fitted in the through hole 32*c* by the elastic force of the spring 42, and the rear end portion 41*d* is separated from a position opposing the proximity switch 53, which is indicated by a chain double-dashed line, to a position indicated by a solid line. For this reason, the proximity switch 53 for detecting the rear end portion 41*d* of the single-sided printing reference pin 41 is turned off. A state wherein the distal end portion 41*c* is fitted in the through hole 33*b* of the rotary gear 33, i.e., a state wherein single-sided printing can be performed is detected. Therefore, the notification unit 71 is not driven by the controller 70.

If the position of the through hole 33*b* is not matched with that of the through hole 32*c* of the fixed gear 32 regardless of phase adjustment of the rotary gear 33, the distal end portion 41*c* of the single-sided printing reference pin 41 cannot be fitted in the through hole 32*c*. For this reason, the rear end portion 41*d* opposes the proximity switch 53, so the proximity switch 53 is turned on to output a detection signal to the controller 70. When a detection signal is output from the proximity switch 53 in a state wherein single-sided printing is set, and the rotary gear 33 is locked with the fixed gear 32, the controller 70 drives the notification unit 71 to notify to an operator that single-sided printing cannot be performed. Upon this notification, the operator phase-adjusts the rotary gear 33 again. Since the proximity switch 53 detects that phase adjustment of the rotary gear 33 is not completed, wasted paper or damage to the machine due to a phase shift can be prevented. In addition, since the phase shift in single-sided printing can be detected with a simple arrangement such as the proximity switch 53, the number of components can be minimized. The single-sided printing reference pin 41 fitted in the through holes 32*c* and 33*b* has a function of preventing a phase shift of the rotary gear 33 with respect to the fixed gear 32 upon reception of a shock load due to sudden stop or the like in a single-sided printing mode.

Upon completion of this preparation for single-sided printing, as shown in FIG. 1, the reversing cylinder 13 and the double-diameter cylinder 12 are in phase such that the gripper unit 25 is in contact with the gripper unit 19. With the above arrangement, when all the cylinders are rotated, the paper sheet 29 printed between the blanket cylinder 1 and the first impression cylinder 5 is gripped from the gripper unit 4 of the first impression cylinder 5 to the gripper unit 16 of the transfer cylinder 11, and then from the gripper unit 16 of the transfer cylinder 11 to the gripper unit 19 or 20 of the double-diameter cylinder 12. The paper sheet 29 is wound on the upper-side surface of the double-diameter cylinder 12. When the leading end of the paper sheet 29 reaches the contact point between the double-diameter cylinder 12 and the reversing cylinder 13, the paper sheet 29 is gripped from the gripper unit 19 or 20 of the double-diameter cylinder 12 to the gripper unit 25 of the reversing cylinder 13. The paper sheet 29 is wound on the lower-side surface of the reversing cylinder 13 and then gripped and conveyed by the gripper unit 9 of the second impression cylinder 10. The same surface as that printed in advance is printed while passing between the blanket cylinder 6 and the second impression cylinder 10.

In this embodiment, the lock releasing means, consisting of the lever 60 and the air cylinder 63, for releasing the locked state between the rotary gear 33 and the fixed gear 32 is also used as a disengaging means for releasing the single-sided printing reference pin 41 from the through hole 33*b* of the rotary gear 33. However, the present invention is not limited to this, and a disengaging means may be independently provided. Although the single-sided printing reference pin 41 is arranged on the fixed gear 32 side, it may also be arranged on the rotary gear 33 side. The cylinder having the fixed gear 32 and the rotary gear 33 can be the reversing cylinder 13 or an upstream cylinder with respect to the reversing cylinder 13 along the paper convey direction. In addition, in the above description, one set of the through holes 32*b* and 33*b*, the single-sided printing reference pin 41, and the proximity switch 53 is arranged. However, a plurality of such sets may be circumferentially arranged on the side surface of the fixed gear at the same interval, and a phase shift in single-sided printing may be detected when any one of the proximity switches is turned on.

As has been described above, according to the present invention, a detecting means for detecting that the rotary gear is positioned in phase for single-sided printing. For this reason, a phase shift of the rotary gear in single-sided printing can be detected by the detecting means, thereby preventing damage to the machine due to the phase shift. Whether or not single-sided printing can be performed can be automatically displayed by the detecting means.

In addition, according to the present invention, a releasing means for automatically disengaging the reference pin from the reference hole in switching from single-sided printing to perfecting printing is arranged. Since the reference pin is automatically removed from the reference hole in switching from single-sided printing to perfecting printing, the reference pin is prevented from being left unremoved, thereby preventing damage to the printing apparatus during a switching operation.

Furthermore, according to the present invention, a releasing means for performing release of the fixing means for fixing the rotary gear to the fixed gear and release of the reference pin in an interlocked manner is arranged. For this reason, release of the locked state between the rotary gear and the fixed gear and disengagement of the reference pin can be simultaneously performed by the releasing means.

What is claimed is:

1. A printing switching apparatus for a sheet-fed rotary press with a reversing mechanism, comprising:

a fixed gear fixed to a shaft of a first cylinder;

a rotary gear coaxial with said fixed gear and coupled to be driven with a second adjacent cylinder along a paper convey direction, said rotary gear being phase-adjustable with respect to said fixed gear in a circumferential direction;

fixing means for fixing said rotary gear to one of said fixed gear and said shaft of said first cylinder to perform rotational transmission such that phase switching of said rotary gear between single-sided printing and perfecting printing is performed when said fixing means is released, and said rotary gear is not fixed to one of said fixed gear and said shaft of said first cylinder; and detecting means for detecting that said rotary gear is positioned in a phase of single-sided printing when said rotary gear is fixed to one of said fixed gear and said shaft of said first cylinder by said fixing means.

2. An apparatus according to claim 1, further comprising a reference pin provided to one of said rotary gear and said fixed gear including said shaft of said first cylinder and a reference hole formed in the other of said rotary gear and said fixed gear including said shaft of said first cylinder and engaged with said reference pin when said rotary gear is positioned in the phase of single-sided printing, and wherein said detecting means detects that said reference pin is engaged with said reference hole on the basis of a displacement of said reference pin.

3. An apparatus according to claim 2, further comprising releasing means for releasing engagement between said reference pin and said reference hole when single-sided printing is to be switched to perfecting printing.

4. An apparatus according to claim 3, further comprising biasing means for biasing said reference pin in a direction to be engaged with said reference hole, and wherein said fixed gear has an annular stepped small-diameter portion on an outer circumferential surface, said rotary gear has an annular shape and is rotatably held on the outer circumferential surface of said stepped small-diameter portion of said fixed gear, a guide hole for movably holding said reference pin is formed in a side surface of one of said fixed gear and said rotary gear, said reference hole is formed in a side surface of the other of said fixed gear and said rotary gear in correspondence with said guide hole, and said releasing means removes said reference pin from said reference hole against a biasing force of said biasing means to release engagement between said reference hole and said reference pin.

5. An apparatus according to claim 3, wherein said releasing means releases engagement between said reference pin and said reference hole and releases a fixed state of said rotary gear by said fixing means in an interlocked manner.

6. An apparatus according to claim 4, wherein said releasing means is constituted by driving means, a press member driven by said driving means, a first releasing lever pressed by said press member to remove said reference pin from said reference hole against the biasing force in a direction of said reference hole, and a second releasing lever pressed by said press member to release a fixed state of said rotary gear by said fixing means.

7. An apparatus according to claim 2, wherein said detecting means is constituted by a switch including a mechanical proximity switch for detecting a rear end portion of said reference pin whose distal end portion is engaged with said reference hole by one of mechanical, optical, magnetic, and capacitive methods, said switch outputting a signal representing that said reference pin is engaged with said reference hole when said rear end portion of said reference pin is not detected.

8. An apparatus according to claim 1, further comprising control means for outputting a drive signal when three conditions as setting of single-sided printing, fixing of said rotary gear by said fixing gear, and a detection output from said detecting means are satisfied, and notifying means, driven in accordance with the drive signal from said control means, for notifying that said rotary gear is not positioned in the phase of single-sided printing.

* * * * *